US005448970A

United States Patent [19]

Bray

[11] Patent Number: 5,448,970

[45] Date of Patent: Sep. 12, 1995

[54] CRANKSHAFT CONNECTION FOR INTERNAL COMBUSTION ENGINE

[76] Inventor: William R. Bray, P.O. Box 274, Holt, Fla. 32564

[21] Appl. No.: 372,015

[22] Filed: Jan. 12, 1995

[51] Int. Cl.[6] ..... F02B 75/04

[52] U.S. Cl. ..... 123/53.1; 123/197.4

[58] Field of Search ..... 123/53.1, 197.4, 197.1, 123/311, 48 R, 21

[56] References Cited

U.S. PATENT DOCUMENTS

| | | | |
|---|---|---|---|
| 247,741 | 10/1881 | Benier | 123/197.4 |
| 1,567,172 | 12/1925 | Powell | 123/197.1 |
| 1,663,261 | 3/1928 | Powell | 123/53.1 |
| 1,978,058 | 10/1934 | Peterson | 123/197.4 |
| 2,166,211 | 7/1939 | Gray | 123/53.1 |
| 2,493,718 | 1/1950 | Chronic et al. | 123/197.4 |
| 2,659,351 | 11/1953 | Chronic et al. | 123/197.4 |
| 4,917,066 | 4/1990 | Freudenstein et al. | 123/197.4 |

FOREIGN PATENT DOCUMENTS

| | | | |
|---|---|---|---|
| 1019771 | 1/1953 | France | 123/197.4 |
| 90/05862 | 5/1990 | WIPO | 123/197.4 |

*Primary Examiner*—David A. Okonsky
*Attorney, Agent, or Firm*—Keaty & Keaty

[57] ABSTRACT

The invention relates to internal combustion engines and provides for the use of a piston cylinder within which a piston slidably reciprocates. A piston rod is pivotally attached at one of its ends to the piston and at its second end to a connector arm which is mounted for pivotal movement below the piston cylinder. A connecting rod is carried by the connector arm to rotate a crankshaft about an axis which is spaced from the pivotal axis of the connector arm. The connecting rod is secured to the connecting arm a distance from the piston rod to transmit the rotational movement to the crankshaft. When the piston moves from a top dead center position to a bottom dead center position, the crankshaft rotates by more than one half of a full revolution, thereby increasing efficiency of the engine.

10 Claims, 5 Drawing Sheets

CRANKSHAFT CONNECTION FOR INTERNAL COMBUSTION ENGINE

BACKGROUND OF THE INVENTION

This invention relates to internal combustion engines, and more particularly to a design of connecting a piston with a crankshaft in such a manner as to improve efficiency of the engine.

The internal combustion engines have long been used in the automotive industry in the form of a four cycle gasoline engine which operates in four basic cycles: intake, compression, power and exhaust. Automobile manufacturers strive to improve the fuel efficiency of an engine and increase power generated by the engine through modifications including the use of fewer moving parts in the engine, increasing the relative length of the power stroke relative to the other three cycles of the engine operation and other similar improvements. However, the piston rod-crankshaft connection remains relatively unchanged and various attempts to improve this area of an engine operation has not been totally successful. Therefore, there exists a need for an improvement in the piston rod-crankshaft connection for the purpose of improving efficiency of the engine which can be made in a simple and inexpensive way.

SUMMARY OF THE INVENTION

It is, therefore, an object of the present invention to provide an improved piston-crankshaft connection for a variable stroke engine.

It is another object of the present invention to provide an improved connector for a piston rod and the crankshaft which increases the rotation of the crankshaft with each power stroke.

It is another object of the present invention to provide a connection between the piston rod and the crankshaft which allows to decrease the amount of rotation necessary to raise the piston in the exhaust stroke.

It is a further object of the present invention to provide an improved connector between the piston rod and the crankshaft to reduce the deviation of the center of the piston rod from the center of the piston cylinder during rotation of the crankshaft.

These and other objects of the present invention are achieved through a provision of an internal combustion engine which comprises a piston cylinder within which a piston is slidably reciprocated. A piston rod is pivotally attached by one of its ends to the piston and at its second end securely attached to a connector arm located below the piston cylinder. A connector arm is mounted for a pivotal movement about a first axis spaced from the point at which the piston rod is attached. A connecting rod is carried by the connector arm to extend outwardly from the connector arm and to pivotally connect to a crankshaft which is mounted for rotation about a second axis. The connecting rod transmits linear movement to the crankshaft causing its rotation about a second axis in response to the movement of the piston within the cylinder.

When the piston moves between a top dead center position and a bottom center position, the crankshaft is rotated by more than one half of a full revolution, thereby increasing efficiency of the engine. The axis of rotation of the crankshaft can be located above or below the first axis about which the connector arm pivots.

BRIEF DESCRIPTION OF THE DRAWINGS

Reference will now be made to the drawings, wherein like parts are designated by like numerals and wherein.

DETAIL DESCRIPTION OF THE PREFERRED EMBODIMENT

Figure 2:
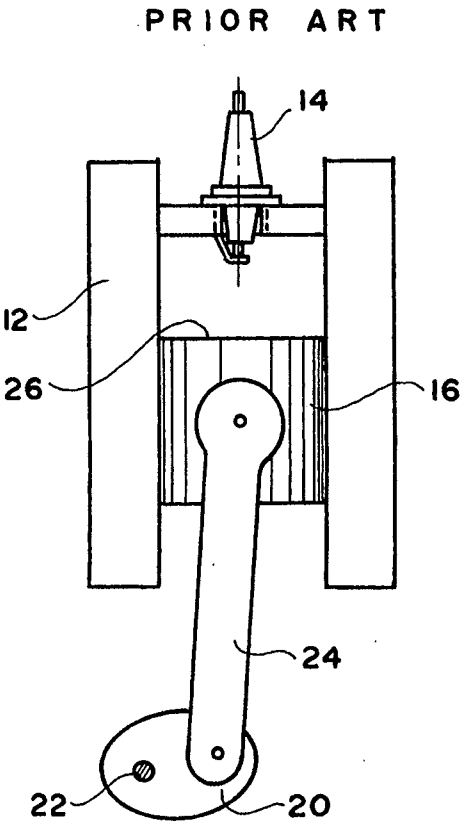
FIG. 2 is a schematic view of a conventional piston rod-crankshaft connector with a piston reaching halfway down within the cylinder and the crankshaft rotated 180 degrees.
Figure 1:
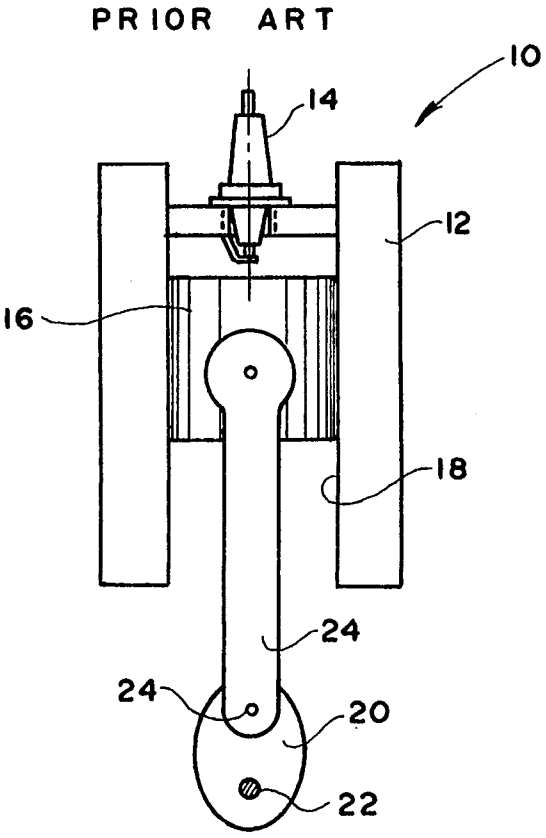
FIG. 1 is a schematic illustration of a conventional piston in a position of a top dead center for ignition with a crankshaft rotation.

Referring now to the drawings in more detail, numeral 10 designates an internal combustion engine, for example a four cycle engine having four separate cycles of power, exhaust, intake and compression. As shown in FIGS. 1 and 2, a conventional engine includes a piston cylinder 12 incorporating a spark plug 14 and a piston 16 which moves between the inner walls 18 of a piston cylinder 12. The piston 16 moves in a sliding manner within the cylinder 12 from a top dead center position shown in FIG. 1 to a bottom dead center position shown in FIG. 2. A crankshaft 20 is mounted for rotation within the engine 10, rotating about a pivot point 22 when the piston rod 24, which is secured to the crankshaft 20 at a point 26, moves the crankshaft in a circular motion. The piston rod and the crankshaft are connected for rotation about a shaft passing through the pivot point 26.

When the piston 16 is on an up stroke, moving from its bottom dead center position towards the spark plug 16, the piston rod 24 is oriented at an angle to a vertical axis of the cylinder 12 which creates a considerable pressure on the piston 16 and causes the piston 16 to become misaligned in relation to the vertical axis of the cylinder and press against one side of the piston, such as at 26, resulting in wear of the cylinder wall. Additional disadvantage of conventional designs is that the crankshaft 20 rotates 180 degrees when the piston rod 24 moves the piston 16 between its top and bottom positions.

Figure 3:
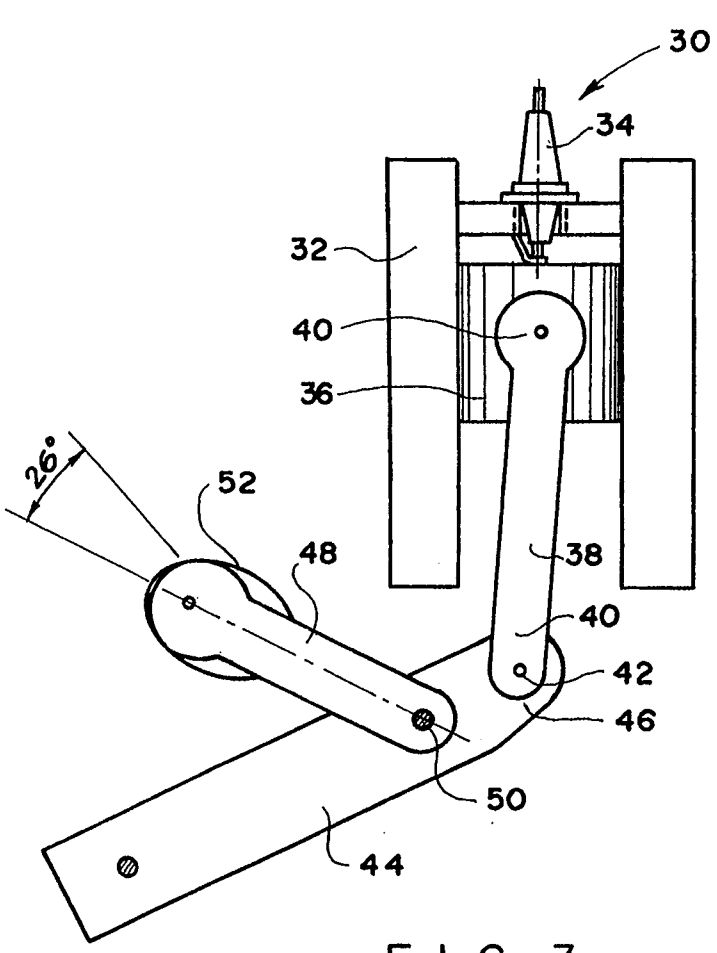
FIG. 3 is schematic illustration of the connector of the present invention with the piston in the top dead center position for ignition with zero degrees crankshaft rotation.

Turning now to the first embodiment of the present invention illustrated in FIG. 3, the engine in accordance of that embodiment is designated by numeral 30 and is shown to comprise a cylinder 32 having a spark plug 34 for igniting the mixture in a gasoline engine. Since the operation of the engine and the generation of combustion through compression of the fuel is known in the art, it will not be described further.

Slidably moving within the piston cylinder 32 is a piston 36 which has a piston rod 38 pivotally connected to it at a point 40. The piston rod 38 extends downwardly from the piston 36 and is connected at its lower end 40, at a point 42, to a first end 46 of the connector arm 44. A connecting rod 48 is secured to the connector arm 44 at a point 50, at one of its ends, and to a crankshaft 52 at its other end. In the embodiment of FIG. 3, the connector rod 48 is spaced, along a central longitudinal axis of the connector arm 44, from the piston rod 38. In this embodiment, the crankshaft 52 is located above the connector arm 48 and is mounted for rotation therewith.

The piston 38 is at its top dead center position ready for the power stroke to begin. The center line of the connecting rod 48 is generally lined up with the longitudinal axis of the crankshaft 52, that is the center of the throw on the crankshaft. To facilitate understanding of the operation of the engine in accordance with the present invention an imaginary center line 54 os drawn to designate the centered position of the connecting rod 48 and the center of the crankshaft 52.

Figure 4:
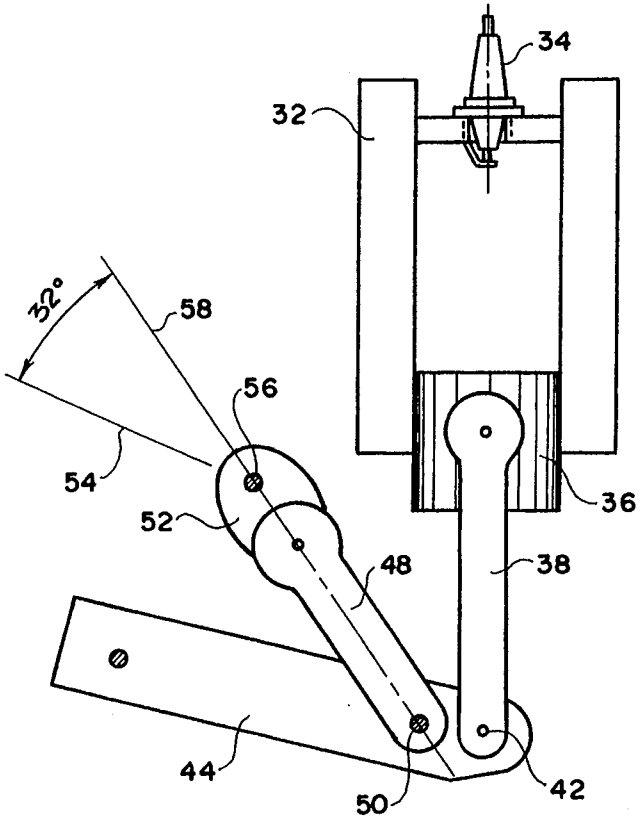
FIG. 4 is a schematic illustration of the engine shown in FIG. 3 during the power stroke, with the piston reaching bottom dead center and the crankshaft rotated more than 180 degrees.

Turning now to FIG. 4, the first embodiment of the present invention is shown with a piston in its dead bottom position and the crankshaft having rotated 180 degrees (conventional rotation) and additional 32 degrees to a total of 212 degrees. Here, the piston 36 is seen in its bottom dead center position, with a piston rod 38 having moved the connector arm 44 downwardly. The connecting rod 48 is likewise moved downwardly due to its attachment to the connector arm at a point 50, which causes rotation of the crankshaft 52 about a pivot point 56.

As shown in FIG. 4, the crankshaft has rotated 180 degrees from the imaginary line 54 and additional 32 degrees towards the imaginary crankshaft center line 58, that is for a total of 212 degrees. When the exhaust stroke returns the piston 36 to the top position shown in FIG. 3, the angle of travel of the crankshaft is only 148 degrees, since a part of the rotation of the crankshaft has been achieved during the downward stroke of the piston.

During movement of the piston, the crankshaft is rotated at a constant speed. But the power stroke of the piston 36 has lasted longer than the upward exhaust stroke. In reality, it means that the piston moves slower in a downward direction that it moves in an upward direction. As a result, more power is derived from the engine of the present invention than from a conventional engine where the power stroke and exhaust stroke last the same amount of time. When the piston 36 is returned to its top dead position and the intake stroke begins, the intake stroke will have the same duration as the power stroke, and the compression stroke will have the same duration as the exhaust stoke.

Figure 5:
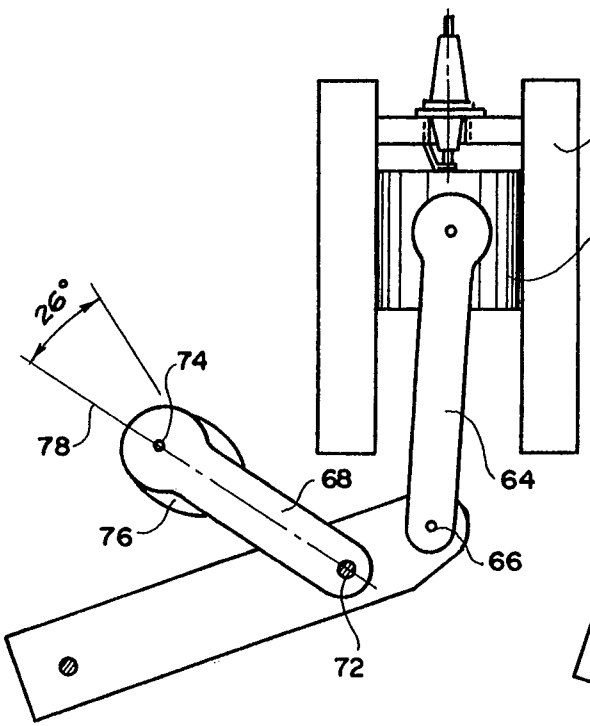
FIG. 5 is a schematic illustration of the second engine in accordance with the present invention wherein the connecting rod is moved farther away from a point of connection of the piston rod and with the piston in its top dead center position.

FIG. 5 illustrates a second embodiment of the apparatus in accordance with the present invention which also illustrates an engine having a piston cylinder 60 within which slidably moves a piston 62. The piston rod 64 is connected to the same pivot point 66 as in the first embodiment of the invention illustrated in FIGS. 3 and 4.

Figure 6:
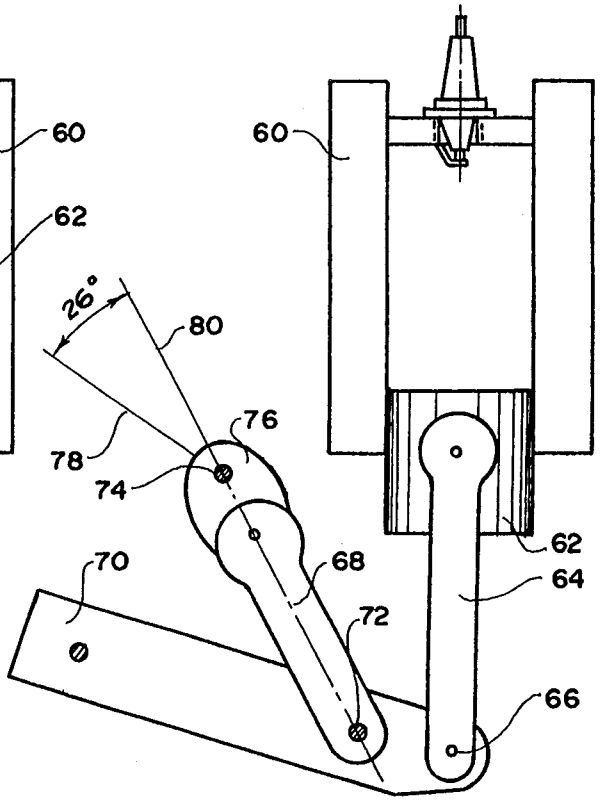
FIG. 6 is a schematic illustration of the embodiment shown in FIG. 5, with the piston reaching its bottom dead center position and the crankshaft rotated more than 180 degrees in relation to the view of FIG. 5.

However, the connecting rod 68 is attached to the connector arm 70 at a point farther removed from the pivot point 66 and pivots about a pivot point 72. In the embodiment of FIG. 5, the piston 62 is in its uppermost position where the power stroke begins and the pivot pins engaging the connecting rod at the pivot point 72 and a pin 74 attaching the connecting rod to a crankshaft 76 are aligned along an imaginary line 78. When the piston 62 moves downwardly, forcing the connector arm 70 downward and imparting rotation on the connecting rod 68, the crankshaft 76 rotates 180 degrees, as is conventional in the art, and also rotates additional 26 degrees as shown by an imaginary line 80 of FIG. 6. The exhaust stroke and the intake stroke follow, so as to complete the cycle of the engine operation.

Figures 7, 8, 9:
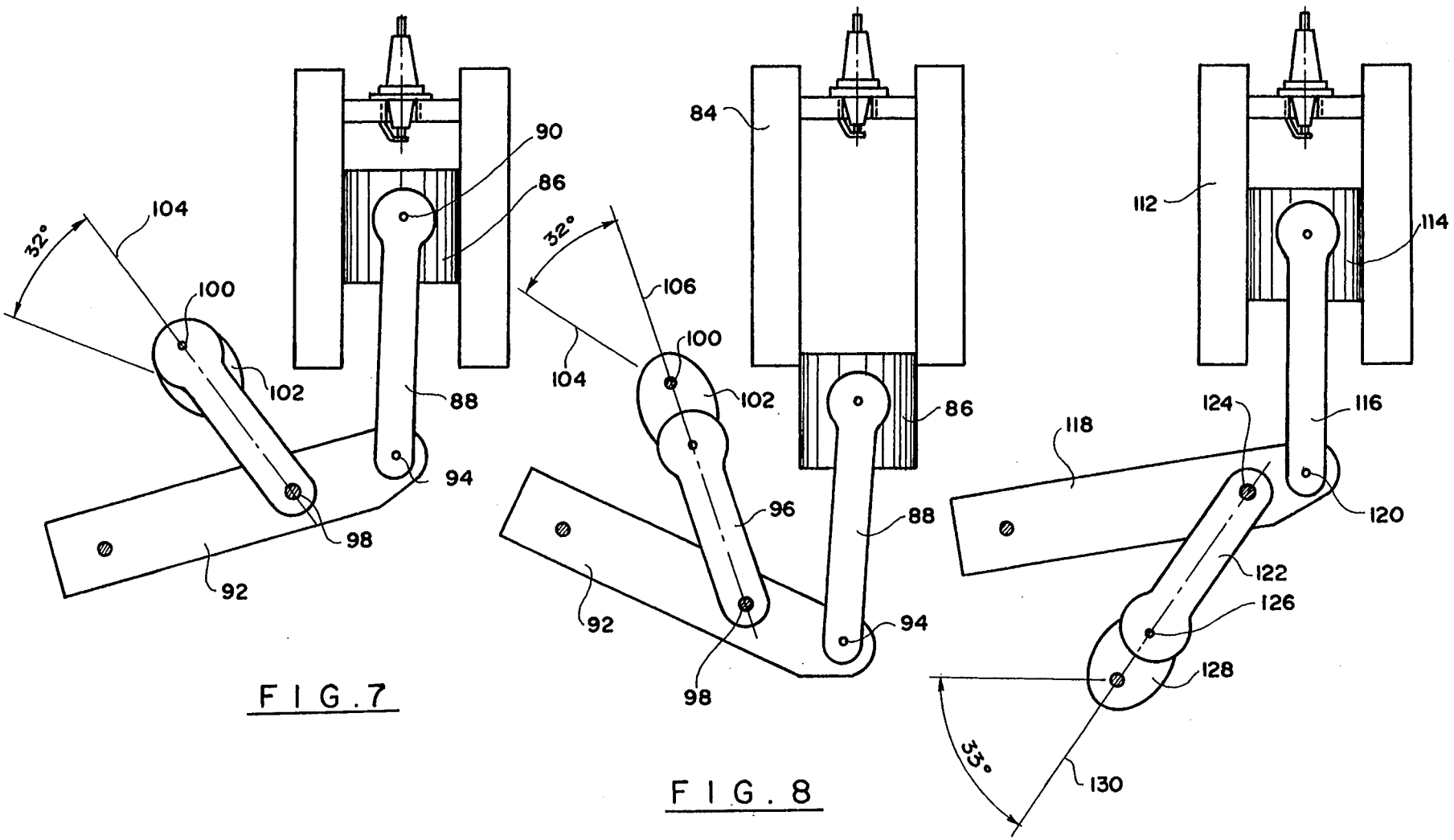
FIG. 7 is a schematic illustration of the third embodiment of the connector in accordance with the present invention, wherein the connecting rod is moved even farther away from the attachment point of the piston rod along the connecting arm, with the piston in the top dead center position.
FIG. 8 is a schematic illustration of the third embodiment of the engine design in accordance with the present invention, with the piston in its bottom dead center position and the crankshaft rotated more than 180 degrees.
FIG. 9 is a schematic illustration of the fourth embodiment of the engine design in accordance with the present invention, with the piston in a top dead center position, and with a connecting rod and the crankshaft moved downwardly in relation to the connector arm and the piston rod.

Turning now to the third embodiment of the present invention illustrated in FIGS. 7 and 8, the multi-cycle engine is shown to comprise a piston cylinder 84 within which slidably moves a piston 86. A piston rod 88 is pivotally attached to the piston at a point 90 and is pivotally attached to a connector arm 92 at a pivot point 94. The pivot point 94 is the same pivot point for the piston rod as shown in FIGS. 3–5. The difference of the embodiments in FIGS. 7 and 8 is that the connecting rod 96 is moved even closer to the geometric center of the connector arm 92, that is away from the pivot point 94 along the center line of the connector arm 92.

FIG. 7 illustrates the piston in its uppermost position, with a pivot point 98, which connects the connector arm and the connecting rod, and the pivot point 100, which connects the connecting rod to a crankshaft 102, aligned approximately through the center of the crankshaft 102 along an imaginary line 104. When the piston 86 moves to its lowermost position, as shown in FIG. 8, the crankshaft 102 has rotated 180 degrees plus 17 degrees, so that the center of the crankshaft appears to pass through an imaginary line 106. As with the previous embodiments, the total angle traversed by the crankshaft during the power stroke and the intake stroke continues to increase, while the piston rod moves from its upward to its lowermost position.

The embodiments shown in FIGS. 9–14 illustrate the crankshaft mounted in a position below the connector arm. This can be another way of building an engine, depending on the particular space available for the operation of the connector arm and the connecting rod within the allotted area in an automobile.

Figure 10:
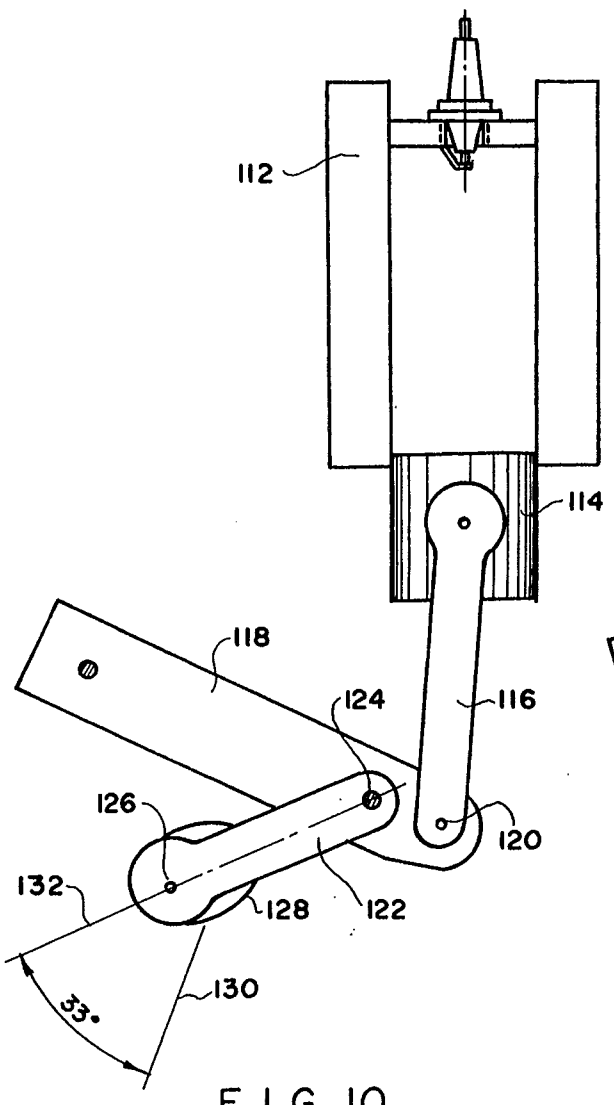
FIG. 10 is a schematic illustration of the engine design in accordance with the fourth embodiment of the present invention, with the piston in its downward position and the crankshaft rotated more than 180 degrees.

FIGS. 9 and 10 illustrate the fourth embodiment of the engine design in accordance with the present invention. The design shown in FIGS. 9 and 10 comprises a piston cylinder 112 having a piston 114 which moves in a slidable manner with the interior walls thereof. A piston rod 116 connects the piston 116 with a connector arm 118 at a pivot point 120.

A connecting rod 122 is secured to the connector arm 118 a short distance away from the pivot point 120 for rotation about a pivot point 124. The point of rotation 124 is similar to the point of rotation used in the first embodiment of the engine design in accordance with the present invention which is illustrated in FIGS. 3 and 4.

The connecting rod 122 extends downwardly from the connector arm 118 to connect at a point 126 with a crankshaft 128. The crankshaft is forced to rotate in response to the movement of the connecting rod about the pivot point 126, as shown in FIG. 10. At the upmost position of the piston 114 (See FIG. 9) the center of the crankshaft extends along an imaginary line 130.

Once the piston 114 moves to its lowermost position, the crankshaft 128 has already rotated 180 degrees and additional 33 degrees, for a total of 213 degrees, as can be seen in FIG. 10. The center line of crankshaft in FIG. 10 is aligned with an imaginary line 132 which is 33 degrees away from the imaginary line 130. The exhaust stoke, therefore, when the piston 114 moves upwardly, will be accomplished with the crankshaft turning only 147 degrees, that is 180 degrees minus 33 degrees. In this embodiment, as in the previous embodiments, the downward stroke of the piston is slower than the following compression stroke giving more time for air and fuel to fill the cylinder which will result in greater intake and efficiency of the engine.

Figure 12:
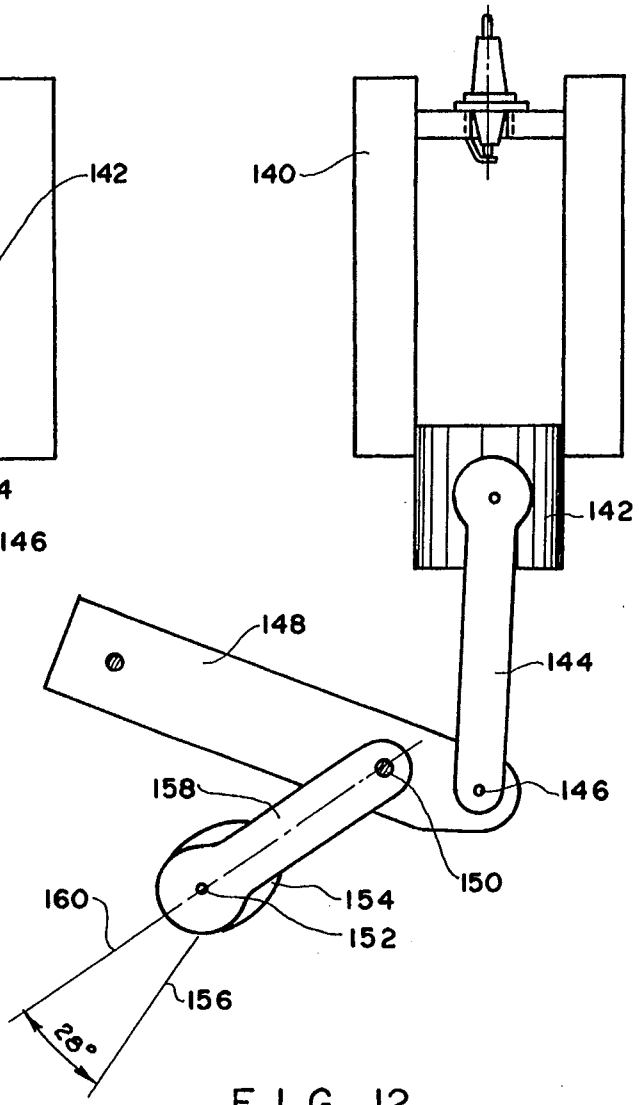
FIG. 12 is a schematic illustration of the embodiment shown in FIG. 11, with the piston in its bottom dead center position and the crankshaft rotated more than 180 degrees.
Figure 11:
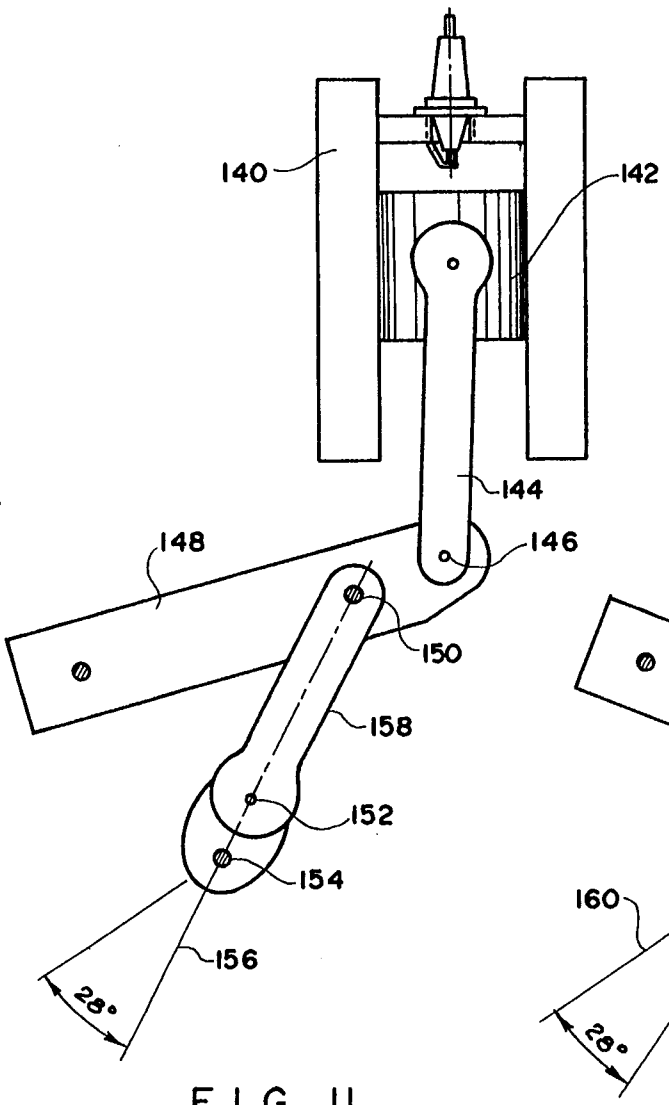
FIG. 11 is a schematic illustration of the fifth embodiment of the engine design in accordance with the present invention, wherein the connecting rod is below the connector arm and is moved farther away from the point of attachment of the piston rod to the connector arm.

FIGS. 11 and 12 illustrate the fifth embodiment of the engine design in accordance with the present invention which is accomplished with a connecting rod and the crankshaft in a position below the connector arm. Shown in FIGS. 11 and 12 is a cylinder 140 within which a piston 142 slidably moves. The piston rod 144 is connected at the same pivot point 146 to a connector arm 148 as in the previous embodiments of FIGS. 3–10.

However, the pivot point 150 which connects the connecting rod to the connector arm 148 is farther removed from the pivot point 146 and is moved closer to the center of the connector arm 148. The center line aligning the connecting points 150, 152 and 154 is aligned with an imaginary longitudinal center line of the crankshaft 154, and is shown extending as an imaginary line 156 in FIG. 11.

In FIG. 11, the piston 142 is in its uppermost position ready for a power stroke. When the cylinder 142 moves down, pushing the piston rod 144, the force is transmitted as rotational force to the connector arm 148, causing downward movement of the connecting rod 158 and imparting rotation on the crankshaft 154. As a result, the center of the crankshaft 154 is seen to have rotated 180 degrees and additional 28 degrees from an imaginary line 156 to an imaginary line 160. Returning to the upward position in the exhaust stroke, the piston will force the crankshaft to rotate 152 degrees, that is 180 degrees minus 28 degrees that have already been covered by the downstroke movement of the piston 142. The intake stroke follows and the crankshaft rotates again at 180 degrees and an additional 28 degrees. Then the compression stroke follows with the crankshaft rotating 150 degrees, that is 28 degrees less than is necessary for a half revolution.

Figure 14:
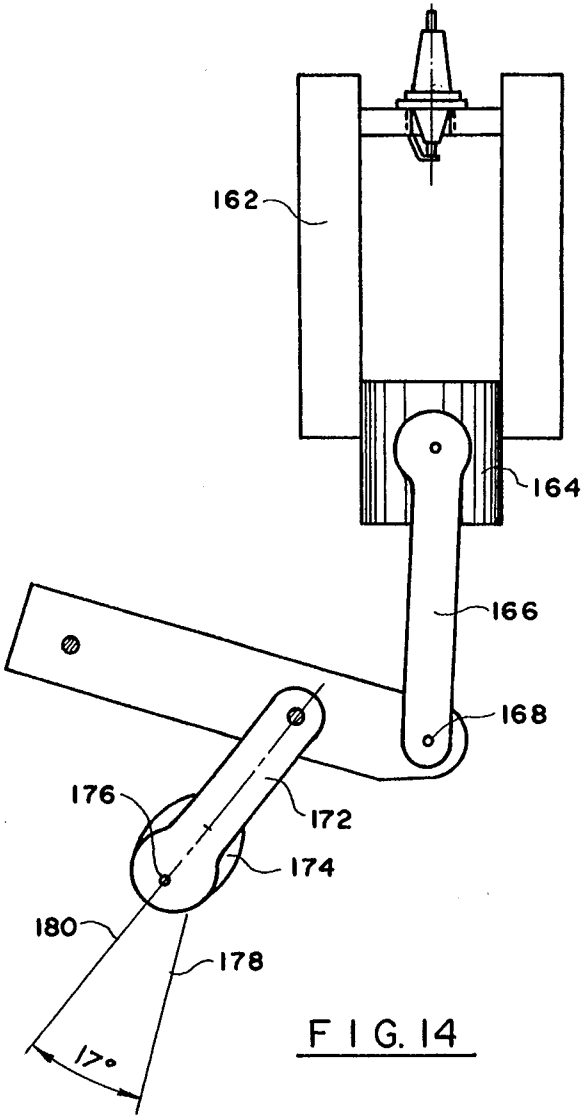
FIG. 14 is a schematic illustration of the engine design shown in FIG. 13, with the piston in its bottom dead center position.
Figure 13:
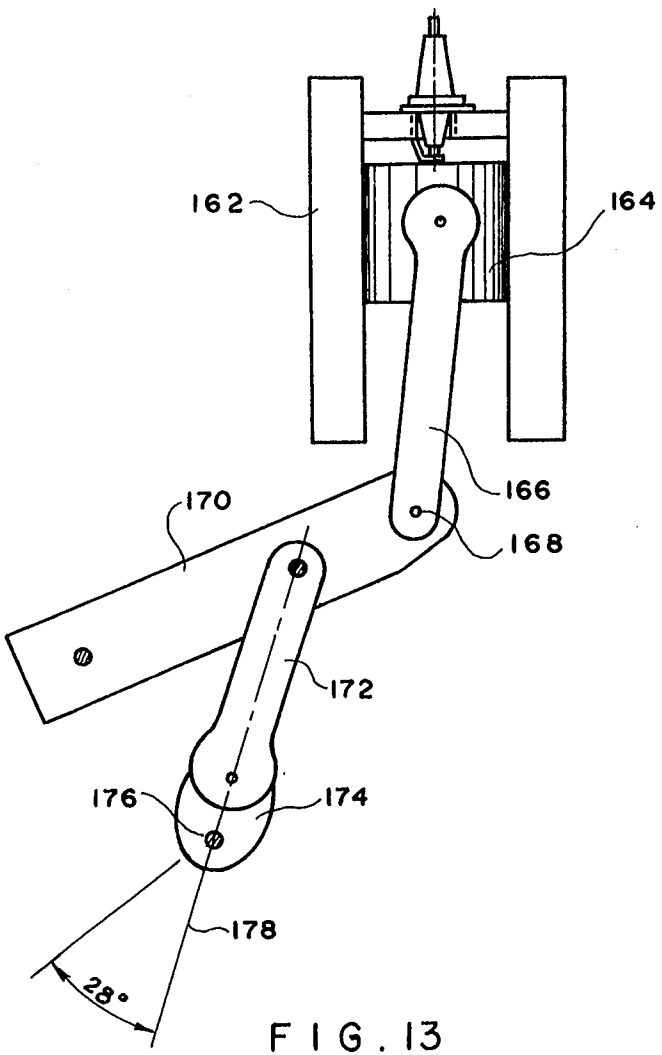
FIG. 13 shows the sixth embodiment of the engine design in accordance with the present invention, with the piston in its top dead center position ready for ignition and the connecting rod moved even farther away from the piston rod along the connector arm.

FIGS. 13 and 14 illustrate the sixth embodiment of the engine design in accordance with the present invention, with the crankshaft mounted below the connector arm, similar to the embodiments of FIGS. 9–12. The engine of the embodiment of FIGS. 13 and 14 is shown to comprise a piston cylinder 162 within which a piston 164 slidably moves. A piston rod 166 is pivotally connected at a point 168 to a connector arm 170, and a connecting rod 172 is connected to the connector arm at a point even farther removed from the pivot point 168 along the length of the connector arm 170. The connecting rod 172 is engaged with a crankshaft 174 and forces its rotation about a pivot point 176.

In FIG. 13, when the piston 164 is in its uppermost position, the center of the crankshaft is aligned with an imaginary line 178, while in the position of piston shown in FIG. 14, that is the lowermost position of the piston, the center of the crankshaft is aligned with an imaginary line 180. To arrive at the imaginary line 180, the crankshaft 174 has already traveled 180 degrees and an additional 21 degrees for a total of 201 degrees, requiring the crankshaft to rotate only 151 degrees on the exhaust stroke. The intake stroke will cause rotation of the crankshaft by 201 degrees, while the compression stroke will cause rotation of the crankshaft by 159 degrees.

With a four cylinder engine, there is a continuous power because of the overlap of power strokes from each cylinder to the following cylinder in different cycles of the piston operation. A principle described in relation to the various embodiments of the present invention can be used in gasoline engines, diesel engines, air compressors and refrigerator compressors.

The advantages of the present invention are seen in the fact that the power stroke increases, producing power for a longer period of time, that is causing the crankshaft to rotate more than 180 degrees. The efficiency of the engine is increased because the intake stroke is increased giving it more time for the air and gas to fill the cylinder, thus creating a greater efficiency on the intake. The connection of the piston rod to the crankshaft is accomplished through the use of two elements, connector arm and connecting rod. This allows to more efficiently move the crankshaft in its rotation cycle. Additionally, the amount of rotation, necessary to raise the piston to the upward position in the exhaust stroke is decreased, thereby allowing to move the piston faster on the exhaust stroke and return the piston to the fuel intake position more quickly.

Additional advantage of the present invention is seen in the fact that the piston rod can be better aligned with the center of the piston during slidable movement of the piston within the cylinder. As a result of a more centered movement the wear on the wall of the piston is reduced. In turn, this increases the efficiency of the engine by reducing friction between the piston and the cylinder wall. The misalignment of the piston with the cylinder can be virtually eliminated, or at least substantially reduced in comparison with conventional engines.

Many changes and modifications can be made within the design of the present invention without departing from the spirit thereof. I, therefore, pray that my rights to the present invention be limited only by the scope of the appended claims.

I claim:

1. An internal combustion engine, comprising:

a cylindrical body;

a piston slidably reciprocating within said cylindrical body;

a piston rod pivotally connected to a piston at a first end thereof and securely connected to a connector arm at a second end thereof, said connector arm comprising an elongated element mounted for a pivotal movement about a first axis;

a connector rod carried by said connector arm; and a crankshaft mounted for rotational movement about a second axis spaced from the first axis, said crankshaft rotating by more than one half of a full revolution when said piston moves from a top dead center position to a bottom dead center position.

2. The engine of claim 1, wherein said first axis is located a distance from a point at which said piston rod is secured to the connector arm.

3. The engine of claim 1, wherein one end of said connector rod is securely attached to said connector arm a distance from said piston rod and from said first axis.

4. The engine of claim 1, wherein a second end of said connector rod is pivotally connected to the crankshaft at a point removed from said second axis.

5. The engine of claim 1, wherein said second axis is located above said first axis.

6. The engine of claim 1, wherein said second axis is located below said first axis.

7. An internal combustion engine, comprising:

a cylindrical body;

a piston slidably reciprocating within said body;

a piston rod pivotally connected to a piston at a first end thereof and securely connected to a connector arm at a second end thereof, said connector arm comprising an elongated element mounted for pivotal movement about a first axis, said first axis being located a distance from a point at which said piston rod is secured to the connector arm;

a connector rod carried by said connector arm, one end of said connector rod being securely attached to said connector arm a distance from said piston rod and from said first axis; and a crankshaft mounted for rotational movement about a second axis spaced from the first axis, said crankshaft rotating by more than one half of a full revolution when said piston moves from a top dead center position to a bottom dead center position.

8. The engine of claim 7, wherein a second end of said connector rod is pivotally connected to the crankshaft at a point removed from said second axis.

9. The engine of claim 7, wherein said second axis is located above said first axis.

10. The engine of claim 7, wherein said second axis is located below said first axis.

* * * * *